US005423547A

United States Patent [19]

Puso

[11] Patent Number: 5,423,547

[45] Date of Patent: Jun. 13, 1995

[54] ARM POSITION MONITORING DEVICE

[76] Inventor: Joseph Puso, 190 Ridge Rd., Rutherford, N.J. 07070

[21] Appl. No.: 49,526

[22] Filed: Apr. 20, 1993

[51] Int. Cl.[6] ..... A63B 69/36

[52] U.S. Cl. ..... 273/187.2; 273/29 A; 343/718

[58] Field of Search ..... 273/187.2, 186.2, 29 A, 273/26 C; 340/574; 343/718, 573

[56] References Cited

U.S. PATENT DOCUMENTS

| | | | |
|---|---|---|---|
| 2,064,603 | 12/1936 | Harrison | 273/187.2 X |
| 3,594,748 | 7/1971 | Grotjahn | 340/574 X |
| 3,717,857 | 2/1973 | Evans | 273/186.2 X |
| 3,860,245 | 1/1975 | Yamada | 273/187.2 |
| 4,193,065 | 3/1980 | Bittner | 273/187.2 X |
| 4,330,123 | 5/1982 | Kleinerman | 473/63 |
| 5,005,835 | 4/1991 | Huffman | 273/187.2 |
| 5,199,712 | 4/1993 | Hoyle et al. | 273/187.2 |
| 5,324,038 | 6/1984 | Sasser | 273/187.2 |

*Primary Examiner*—George J. Marlo
*Attorney, Agent, or Firm*—Ladas & Parry

[57] ABSTRACT

An arm position monitoring device has a housing attachable to an arm of a wearer. A power cell and a sound emitter are connected to emit sound by a trigger in the housing when the arm reaches a predetermined position. The trigger is adjustable so that the sound emitter and power cell may be connected at any of a plurality of optimum positions of the arm while swinging a sporting implement.

13 Claims, 4 Drawing Sheets

ARM POSITION MONITORING DEVICE

This invention relates to a training or teaching device and is particularly concerned with the control or monitoring of body movement during a sporting activity.

The invention finds particularly utility in, for example, the game of golf where, in order to achieve consistency, a player must develop a repetitive swing. The swing starts from a position of address from which the player pivotally rotates in one direction through a backswing and then reverses his direction of rotation to perform a forward swing through the strike zone and on to a follow through or finish position. The various positions adopted during the course of this golf swing will be described in greater detail and with reference to the accompanying drawings. The device of the invention provides indications to the player of, firstly, the point at which the backswing is completed and the forward swing should commence and, secondly, when the follow through at the conclusion of the forward swing has been completed.

Although this specification will describe the invention with particular reference to a golf swing, it will be appreciated that the device has other applications such as, for example, tennis strokes both forehand and backhand.

According to the present invention there is provided a motion monitoring device attachable to a moveable member and including sound emitting means and trigger means for actuating said sound emitting means when said movable member reaches a predetermined position.

The inventions finds particular application as an athletic swing training device and, accordingly, provides an athletic swing training device including a housing attachable to the arm of a wearer, said housing accommodating a power cell, a speaker, and switch means, said switch means being operable to establish contact between said power cell and speaker to generate an audible signal when the arm of the wearer adopts a predetermined position.

A specific application is as a golf training or teaching device and, accordingly, the invention provides a golf swing training device including a housing attachable to the forearm (including wrist) of a wearer, said housing having a base and an upstanding peripheral wall, a plug dimensioned to nest within said housing upstanding wall, said plug having a platform with a depending peripheral skirt dimensioned closely to seat within the housing wall, sound emitting means carried on the underside of said plug platform and encased within the depending peripheral skirt, said sound emitting means including a power cell, a speaker and switch means operable to establish contact between said power cell and speaker to generate an audible signal when the wrist of the wearer adopts a predetermined position.

The invention will be now described with reference to the accompanying drawings in which.

Figure 1:
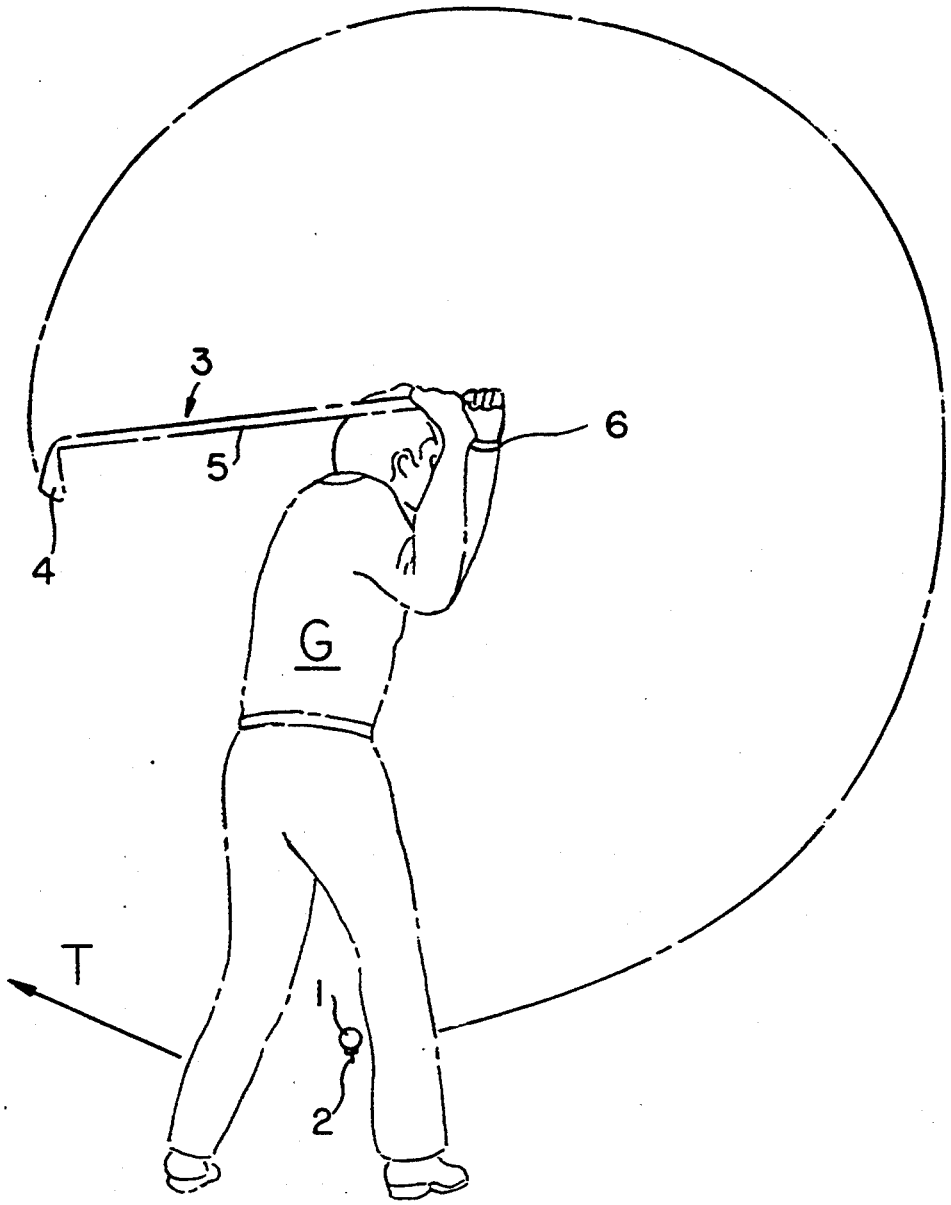
FIG. 1 is a view of a golfer shown in a position at the conclusion of the back swing.

Before describing the device of the invention with specific reference to the above-identified drawings, the basic mechanics and sequential positions of a golf swing will be discussed.

With a golf ball either lying on the ground or resting on a tee and with the intention of hitting that ball to or toward a target, the golfer addresses the ball and, from the position of address, takes the club away, rearwardly and upwardly, through a backswing. At the conclusion of the backswing, the golfer swings the club, in the reverse direction, downwardly and forwardly, to strike the ball and, following impact, continues the forward motion upwardly to a position of rest. This movement following impact to the position of rest is called the follow through.

At the address position, the golfer stands with his feet slightly apart and with the golf ball in front of him at a location between his feet aligned approximately with the golfer's left heel. Throughout this description, all swing movements are described with respect to a golfer who is both right-handed and is playing right-handed. Thus, for the purposes of description and illustration, the left leg will be the leg closest to the target or target area. From that position of address, the golfer effectively pivots by rotating his upper body to turn his back to the target while the golf club moves rearwardly and upwardly.

At the conclusion of the backswing, the golfer's back is turned toward the target and the club is held high above the golfer's head and, ideally, parallel to the target line, i.e. the line from the ball to the target or target area. At this position, the body is coiled or wound up and is ready to unwind to move the club downwardly and forwardly through the ball, forwardly and upwardly to a follow-through position in which the golfer's chest is at least facing the target, i.e. is at right angles to the target line and preferably has moved slightly beyond that position to a point at which the right shoulder is closer to the target than the left shoulder. Here, again, at the conclusion of the follow through, the golfer's hands are held high and the position of the club will depend largely upon the golfer's individual style but will generally lie in a any position from pointing upwardly to lying downwardly and across the golfer's back which is facing away from the target.

The foregoing paragraphs describe, very generally, the motion of a golfer's body in hitting a ball from a position of rest toward a target. The actual positions adopted during the golf swing vary from individual to individual. For example, it has been explained that, at the coiled or wound up position at the end of the backswing before transition from backswing to forward swing, the golf club ideally lies horizontal and parallel to the target line. While such a position can readily be adopted by an individual who is trim and supple, an older or more portly golfer is unable to turn his torso to the same extent and, additionally, may be unable to raise his hands to as high a position at the conclusion of the backswing. Thus the club will not move to a parallel position, but will be angled and, instead of being horizontal, will extend upwardly from the hands.

With the appreciation that golf swings are very individual in nature, it is important that a golfer find the ideal position for his deportment for transition from the backswing to the forward swing and for the concluded follow through position. The device of the present invention is designed to provide an indication to the golfer when his backswing is completed and, for his particular physical stature, no further coiling movement is desirable. This, in turn will facilitate a smooth transition between backswing and forward swing and should reduce the risk of a snatching or jerking movement on the part of the golfer as he begins the forward swing. The transition from backswing to forward swing should be relaxed, smooth and unhurried.

In order to indicate to the golfer when his idiosyncratic backswing is completed, the device illustrated in the drawings of this application provides an audible signal to the golfer alerting him to the fact that his backswing is completed and the forward swing should begin. Similarly, at the conclusion of the follow through, there is preferably again an audible signal given to the golfer that the follow through is completed. By providing a sound signal to be heard at the conclusion of the follow through, the golfer subconsciously will be aware throughout the swing that he is not aiming merely to strike the ball in a chopping action, but that he should continue his forward motion after impact all the way through and up to the audible indication that the follow through is completed.

Referring now to the drawings, FIG. 1 shows a golfer G in a coiled position part way through a golf swing and about to begin the forward motion to strike a ball 1 resting on a tee 2 in a direction along a target line T toward a target, not shown. In the position shown, the golfer has rotated his body, to the right, from a position of address, not shown, in which his shoulders are generally in line with the target line T and the head 4 of the golf club 3 is at rest immediately behind the ball 1. In moving from such an address position to the position shown in FIG. 1, the club head 4 follows the trajectory shown in dotted outline and golfer's shoulders move from the address position generally in line with the path T to the position in which, as shown, the golfer's back is turned to the target and his shoulders are generally at right angles to the target line T. In the position shown in FIG. 1, the weight of the golfer is predominantly on the right foot and his head has moved barely, if at all, from the address position in which his eyes are focussed on the ball 1.

In this coiled position shown in FIG. 1, the shaft 5 of the golf club 3 is shown lying generally parallel to the target line T and this position is indicated to the golfer by the device of the invention more particularly described with reference to FIGS. 3–7. With the backswing completed as shown in FIG. 1, and the body in a coiled position, substantial torque is stored in the golfer's body and is released during the forward swing performed by rotating the golfer's upper body from the position shown in FIG. 1 in the reverse direction from the backswing causing the club to return along a similar, but not necessarily identical, trajectory to that shown in FIG. 1 all the way through to the completed follow through position shown in FIG. 2 of the drawings. During such forward movement, the club head 4 moves through the strike zone to impact the ball 1 and drive the ball 1 generally in the direction of the arrow T. During such forward swing the golfer's weight is transferred from the right leg to the left leg and the shoulders rotate from the position in which the golfer's back is turned on the target (FIG. 1) through a position in which the shoulders lie generally parallel to the target line T (address position—not shown) and on to a position (FIG. 2) in which in the shoulders are at least again at right angles to the target line T but with the golfer's chest directed toward the target. In fact, as most clearly shown in FIG. 2, at the conclusion of the follow through, the golfer adopts a balanced position with essentially all his weight on the left leg and with his shoulders having rotated through and beyond the position at right angles to the target line to the position in which the right-hand shoulder lies closer to the target than the left-hand shoulder.

Figure 2:
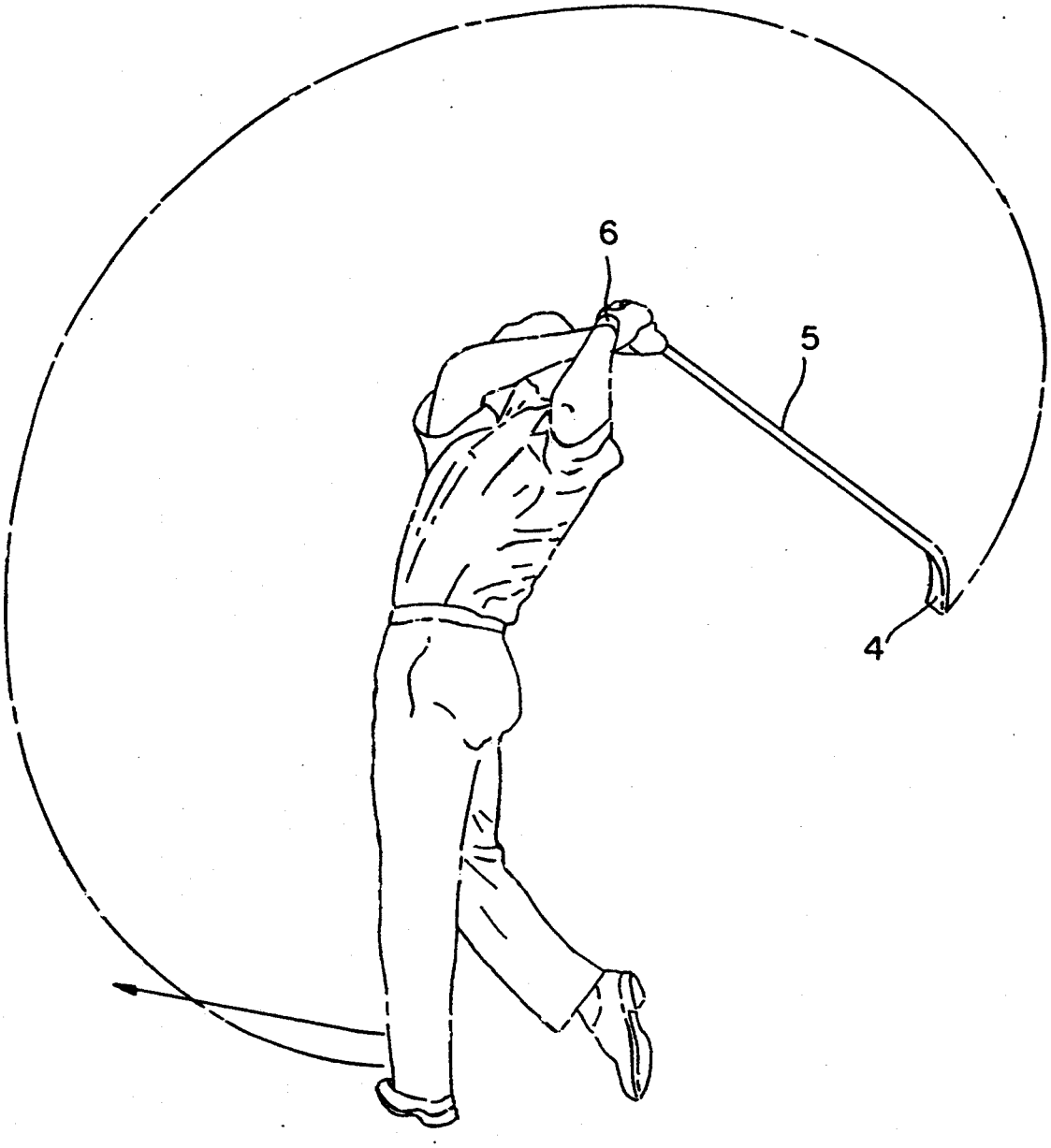
FIG. 2 is a view of the same golfer shown in the follow through position at the conclusion of the forward swing.

The trajectory of the follow through after impact is shown in dotted outline in FIG. 2 of the drawings and, in the balanced position shown, the golfer's hands are high above his shoulders and the club shaft 5 is directed rearwardly and downwardly behind the golfer. In this completed follow through position, a second audible signal is emitted from the device of the invention indicating to the golfer that the swing is completed.

Figure 3:
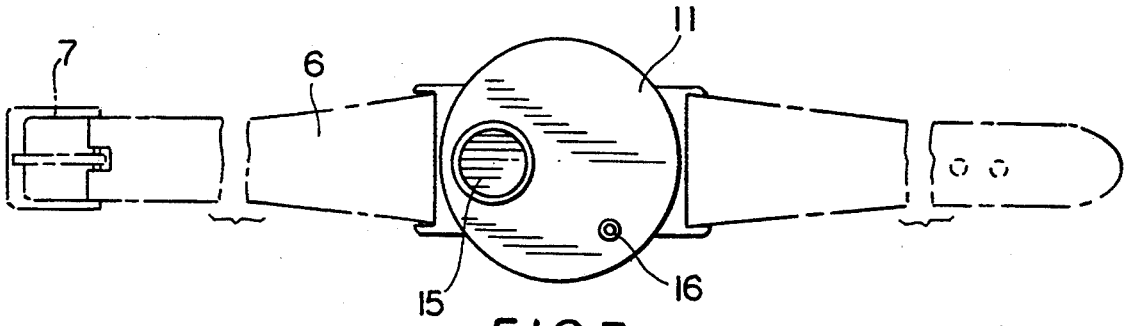
FIG. 3 is a top-plan view of a device of the invention.
Figure 6:
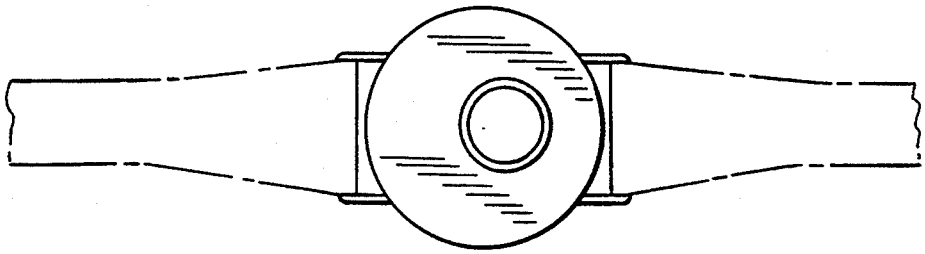
FIG. 6 is a partial top-plan view, similar to FIG. 3 but showing an alternative embodiment of the invention.

As shown most clearly in the alternative embodiments of the FIGS. 3 and 6 of the drawings, the audible indicating device of the invention is most conveniently worn about the wrist of the wearer and is carried by a strap 6 of such dimension as to encircle the wrist and be fastened by a buckle 7. Instead of a conventional buckle fastening, strips of Velcro or like material could be attached to the strip portion to facilitate fastening around the wrist of the wearer. The device comprises a housing 8 having a base 9 and cylindrical upstanding wall 10. The housing 8 is dimensioned to accommodate a plug which carries a sound generating mechanism. The plug includes a platform 11 with a depending cylindrical skirt 12. The outside diameter of the skirt 12 is such that it nests within the upstanding cylindrical wall 10 of the housing 8.

The sound generating mechanism to be described hereinafter is mounted on the underside of the platform 11 and contained within the depending skirt 12. The sound generating mechanism includes a power cell 13, switch means 14, and a loudspeaker 15. The power cell 13 is necessarily compact and is preferably a conventional disc shaped nickel/cadmium battery. If desired, an on/off silencing switch 16 can be provided selectively to activate or deactivate the mechanism.

Figure 5:
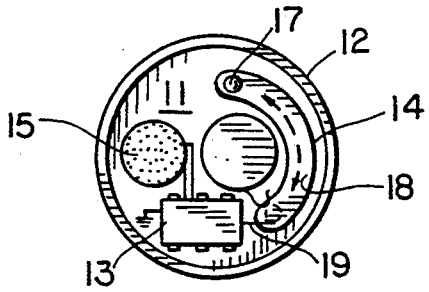
FIG. 5 is a plan view of a portion of FIG. 4.

As shown in FIG. 5, the switch means 14 is a rollerball switch in which a contact ball 17 is seated within a crescent-shaped channel 18 for movement between the extreme ends of the crescent channel. In the position shown in FIG. 5, the ball 17 is at the end of the channel 18 remote from a contact 19.

With the device strapped on the wrist of a golfer, the ball 17 rests at the position shown in FIG. 5 when the golfer has assumed the above-described address position. As the golfer rotates through the backswing, the ball 17 rolls around the channel 18 until the golfer reaches the position shown in FIG. 1 at which point the ball 17 contacts the contact 19 to close the circuit and emit a audible signal from the loudspeaker 15. Upon hearing the audible signal, the golfer briefly pauses, thereby arresting the backswing, and then reverses his direction of pivotal rotation to commence the forward swing. As the golfer moves downwardly through the forward swing, through the strike zone, and upwardly through the follow through, the ball 17 rolls within the channel 18 and is spaced from the contact 19. However, when the forward swing is completed and the follow through position illustrated in FIG. 2 of the drawings is reached, the ball has again moved to the end of the channel 18 to engage the contact 19 whereupon an audible signal is again emitted from the loudspeaker 15 to indicate to the golfer that the follow through is completed.

It has already been explained that, although all golfers may strive to achieve a uniform swing, the golf swing is idiosyncratic in nature and the actual swing performed will depend on the character and temperament, deportment and physique of the golfer. Consequently, the point at which the backswing is completed and, similarly, the point at which the follow through is completed will differ from golfer to golfer and it is necessary to adjust the device of the invention to ensure that the audible signal is not emitted prematurely or latently with respect to each of the desired positions. To this end, the relative dimensions and shapes of the housing wall 10 and the plug skirt 12 are such that the depending skirt 12 of the plug nests within the upstanding side wall 10 of the housing 8, with a relatively close tolerance to permit relative rotational orientation of the plug within the upstanding side wall of the housing.

A set screw 20 in the form of a grub screw extends through a threaded aperture 21 in the upstanding side wall 10 of the housing 8 whereby loosening of the set screw will permit relative rotation of the plug and housing about a common axis of rotation. In this manner the plug can be rotated within the housing to orient the crescent-shaped channel to a position appropriate to the individual swing of the golfer. In order to obtain maximum benefit from its adjustability, a professional instructor will observe a golfer as he hits a few balls and will analyze his swing motion, thereby determining the optimum position to arrest the backswing. The relative position of the plug within the housing will then be adjusted to ensure that the audible sound is emitted at the moment the backswing reaches that optimum position. The set screw 20 is then tightened to clamp the relatively moveable parts in position whereupon the golfer will place the device on his wrist, fasten the buckle and strap and begin to practice hitting golf balls with the assistance that the device will emit audible sounds tailored to his individual swing.

Figure 7:
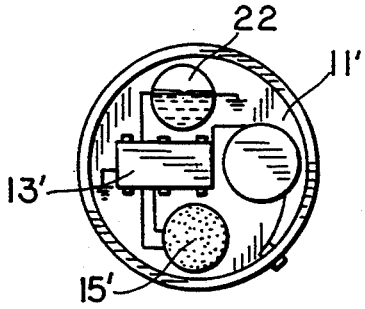
FIG. 7 is a plan view corresponding to FIG. 5, but of the alternate embodiment shown in FIG. 6.
Figure 4:
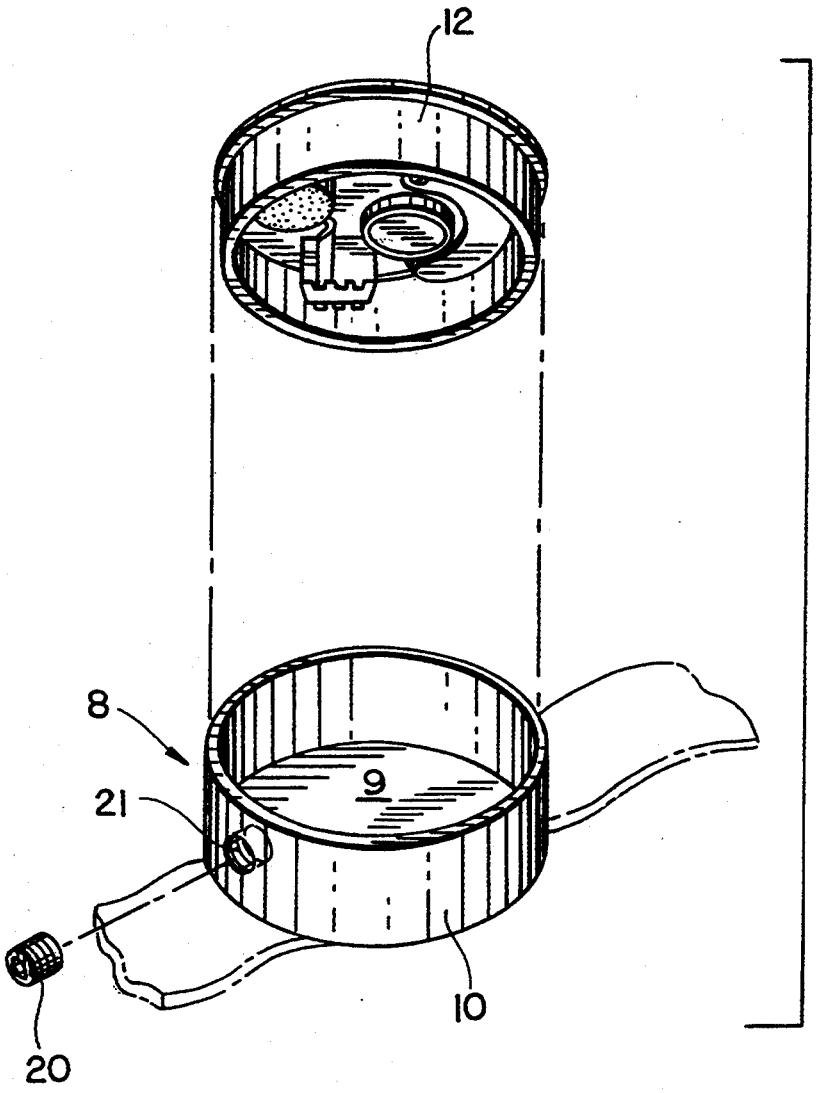
FIG. 4 is an exploded perspective view of a part of FIG. 3.

The embodiment shown in FIGS. 6 and 7 of the drawings differs from that shown in FIGS. 3 to 5 in that it employs a conventional mercury switch 22 instead of the roller-ball switch. Thus, a battery power source 13' is mounted on a platform 11' of a plug and is coupled to mercury switch 22 which, upon imparting the desired degree of tilt to the device, will trigger an alarm and emit an audible noise through a loudspeaker 15'.

The foregoing description does not pretend to be a manual of instruction and is sufficiently detailed only to describe the essential motion throughout a golf swing in order clearly to illustrate the transition zones to be indicated by the device of the invention. Specifically, the description does not described grip, wrist motion, weight shift, lower body movement, and all other movements which must be coordinated to achieve consistency in hitting golf balls. As has further been pointed out, the device of the invention is not restricted in use to a golf swing, but may also be utilized to provide indications of desired positions during, for example, forehand and backhand tennis strokes. Moreover, although described in the form of a wrist-borne device, the device could be incorporated in a ring worn on one of the fingers of the golfer or could form part of a golfing glove traditionally worn.

I claim:

1. A device for monitoring the movement of the arm during a sporting activity comprising:

a housing;

attachment means for attaching said housing to an arm of a wearer;

a power cell;

sound emitting means for emitting a sound to said wearer when connected to said power cell;

trigger means in said housing for connecting said sound emitting means to said power cell in response to said arm reaching a predetermined position while swinging a sporting implement, and means for adjusting said trigger means so that said sound emitting means may be connected to said power cell at any of a plurality of optimum positions of said arm while swinging a sporting implement.

2. A device according to claim 1, wherein said attachment means is for attaching the housing to a forearm of said wearer.

3. A device according to claim 2, wherein said attachment means comprises a wrist encircling band.

4. A device according to claim 3, wherein said power cell comprises a battery and said sound emitting means comprises a speaker.

5. A device according to claim 4, wherein said trigger means comprises a roller contact switch.

6. A device according to claim 5, wherein said housing comprises a base with an upstanding peripheral wall that is dimensioned and shaped to receive rotationally orientably a depending peripheral skirt of a platform of a plug, said depending peripheral skirt being dimensioned to nest within said upstanding peripheral wall, said attachment means being on one of said base and upstanding peripheral wall, and said trigger means being on said platform within a chamber defined by said base, upstanding peripheral wall, platform and depending peripheral skirt.

7. A device according to claim 6, wherein a set screw extends through said upstanding peripheral wall selectively to engage said nested depending peripheral skirt and lock said base and platform in a predetermined relative rotational orientation.

8. A device according to claim 6, and further comprising an on/off actuating switch that is accessible externally of said housing for controlling said sound emitting means.

9. A device according to claim 4, wherein said trigger means comprises a liquid mercury switch.

10. A device according to claim 6, wherein said housing comprises a base with an upstanding peripheral wall that is dimensioned and shaped to receive rotationally orientably a depending peripheral skirt of a platform of a plug, said depending peripheral skirt being dimensioned to nest within said upstanding peripheral wall, said attachment means being on one of said base and upstanding peripheral wall, and said trigger means being on said platform within a chamber defined by said base, upstanding peripheral wall, platform and depending peripheral skirt.

11. A device according to claim 10, wherein a set screw extends through said upstanding peripheral wall selectively to engage said nested depending peripheral skirt and lock said base and platform in a predetermined relative rotational orientation.

12. A device according to claim 10, and further comprising an on/off actuating switch that is accessible externally of said housing for controlling said sound emitting means.

13. The device of claim 1 wherein said sporting activity is the game of golf and said sporting implement is a golf club.

* * * * *